United States Patent [19]

Breitbarth

[11] 4,184,533

[45] Jan. 22, 1980

[54] MACHINE FOR SHAPING SAND INTO CORES OR MOLDS

[75] Inventor: Michael D. Breitbarth, Canby, Oreg.

[73] Assignee: ESCO Corporation, Portland, Oreg.

[21] Appl. No.: 910,763

[22] Filed: May 30, 1978

[51] Int. Cl.[2] ..... B22C 11/04; B22C 15/24

[52] U.S. Cl. ..... 164/181; 164/16; 164/186; 164/201

[58] Field of Search ..... 164/4, 12, 16, 18, 150, 164/154, 155, 181, 201, 186

[56] References Cited

U.S. PATENT DOCUMENTS

| | | | |
|---|---|---|---|
| 1,533,220 | 4/1925 | Campbell | 164/158 |
| 1,533,221 | 4/1925 | Campbell | 164/201 |
| 1,563,156 | 11/1925 | Burman | 164/201 |
| 2,791,012 | 5/1957 | Miller | 164/181 |
| 3,059,294 | 10/1962 | Dunn et al. | 164/16 X |
| 3,528,481 | 9/1970 | Lund | 164/16 X |
| 3,540,520 | 11/1970 | Abraham et al. | 164/201 |
| 3,556,195 | 1/1971 | Lund | 164/16 |
| 3,857,439 | 12/1974 | Bardet | 164/186 |
| 3,888,293 | 6/1975 | Laforet et al. | 164/16 |
| 4,083,396 | 4/1978 | Michelson | 164/16 X |

*Primary Examiner*—Robert D. Baldwin
*Assistant Examiner*—J. Reed Batten, Jr.
*Attorney, Agent, or Firm*—Tilton, Fallon, Lungmus & Chestnut

[57] ABSTRACT

A machine for making a sand part for a metal casting wherein at least three frames, each equipped with means for shaping a sand part, are positioned at spaced apart points on an orbit, and indexed through three stations in the orbit wherein the shaping means are charged, gassed and unloaded.

5 Claims, 14 Drawing Figures

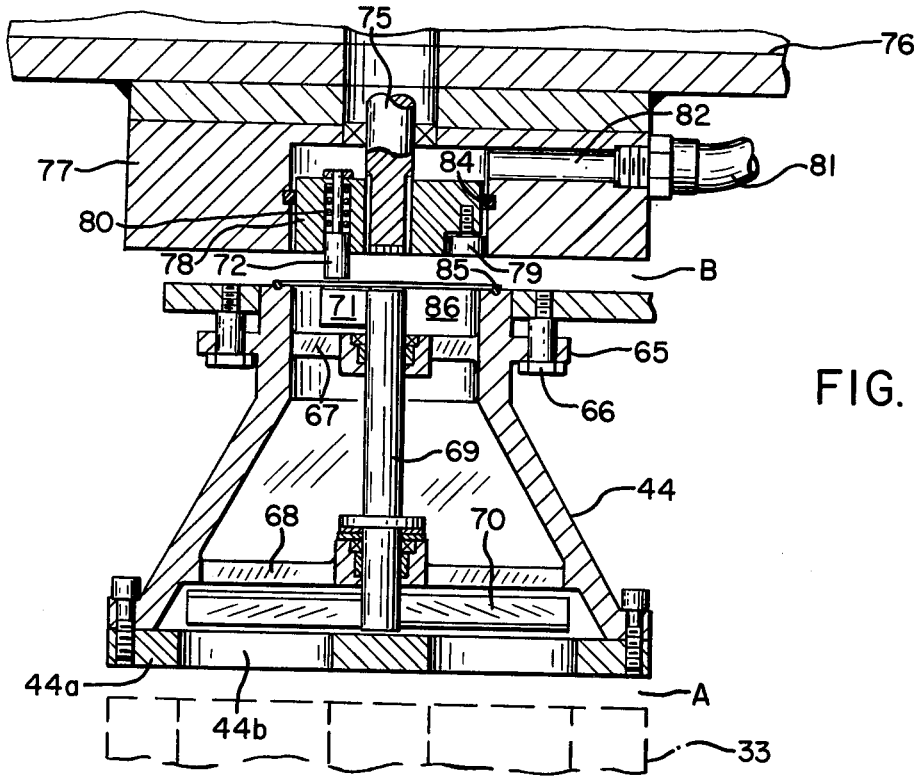
FIG. 4
FIG. 5
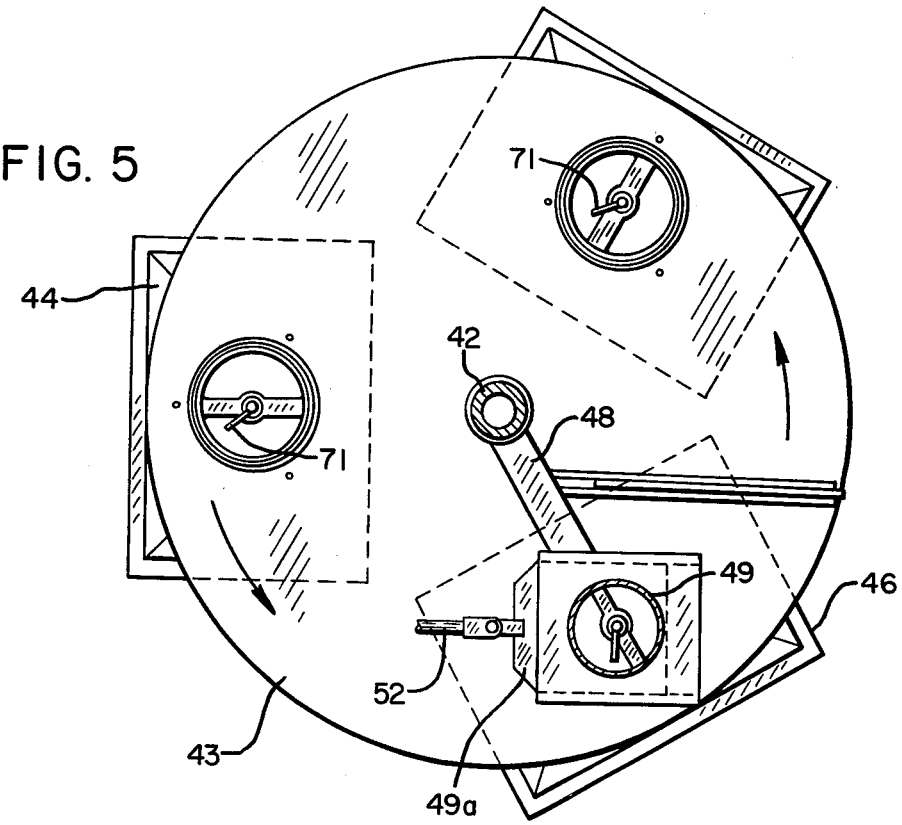

MACHINE FOR SHAPING SAND INTO CORES OR MOLDS

BACKGROUND AND SUMMARY OF INVENTION

This invention relates to a machine for making a sand part for metal casting and, more particularly, for making either or both of cores and molds of a type that do not require heat setting. With the incidence of chemically set sand molds and cores, it is possible to save considerable time and handling labor as well as oven installation expense. However, the procedures for chemically setting of sand parts have not been optimized but, instead, have merely slightly mechanized certain manual actions. This is superseded by the instant invention which makes use of a novel machine for achieving heretofore unattainable efficiencies and advantages of operation and production.

According to the invention, at least three frames each equipped with means for shaping a sand part are positioned at spaced apart points on an orbit—the orbit provided advantageously by a turntable. The turntable is rotated to index the frame through three stations in the orbit. In the first station, each frame successively has its associated shaping means charged with a chemically treated sand. While the charging is going on in the first station, gas setting of an already shaped sand part is occurring in a second station and, simultaneous with these two operations, the set, shaped sand is removed from the shaping means in a third station. This provides an advantageous and compact arrangement which is further enhanced by the provision of a plurality of charging heads indexable in an orbit above and parallel to the first mentioned orbit so that each of the charging heads is positionable above a frame in the charging station. This unique arrangement of moving parts optimizes the labor, time and therefore the efficiency of production.

Other objects and advantages of the invention may be seen in the details of construction and operation set down in the ensuing specification.

DETAILED DESCRIPTION

The invention is described in conjunction with an illustrative embodiment in the accompanying drawing, in which—

FIG. 4 is a fragmentary enlarged vertical sectional view taken through the blow-head and turntable seen in the upper right hand portion of FIGS. 1 and 3;

FIG. 5 is a top plan view of the blow-head turntable;

Figure 1:
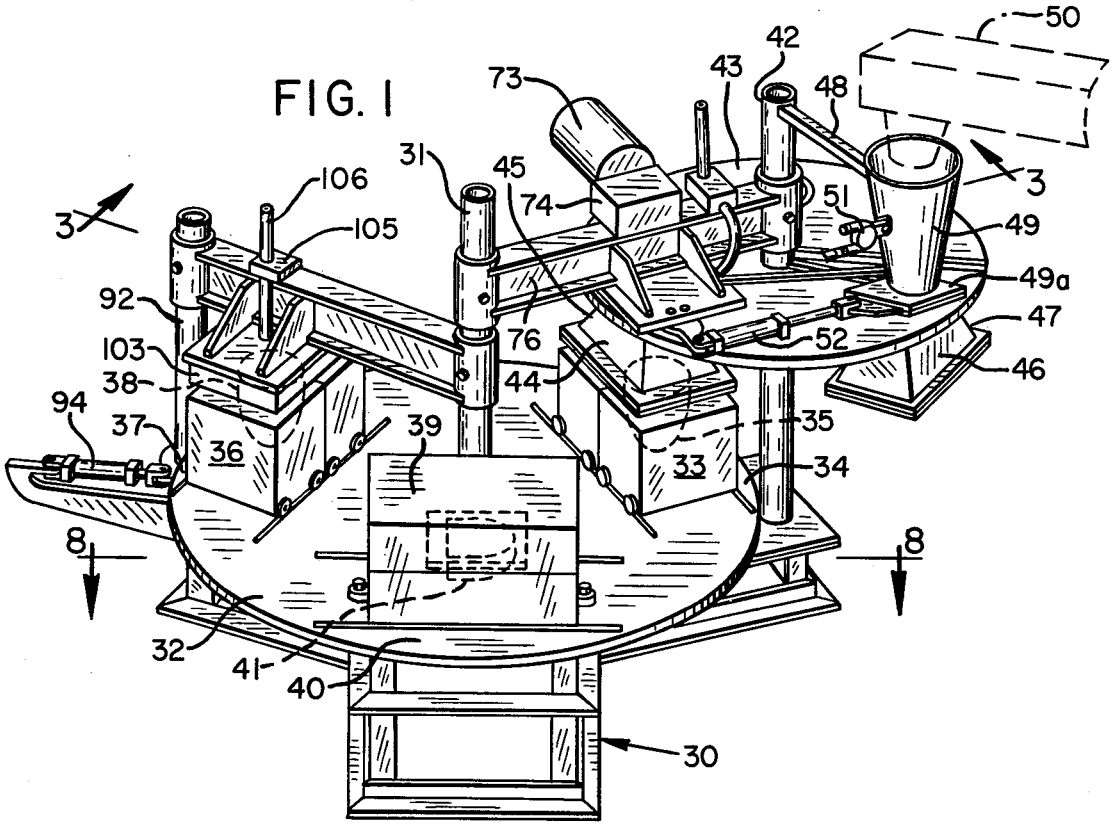
FIG. 1 is a perspective view of apparatus constructed according to the teaching of the instant invention.

In the illustration given, and with reference first to FIG. 1, the numeral 30 designates generally a base which supports a vertically extending post 31 and sleeve 31*a* rotatable thereon. Fixed to the sleeve 31*a* is a first turntable 32. The turntable carries a frame 33 which is seen to be in a charging station 34 and is equipped internally with a sand-part shaping means 35. The turntable 32 is equipped with a second frame 36 which is seen to be in a treating station 37 and which is equipped with its shaping means 38. Thirdly, the turntable 32 is equipped with a third frame 39 which is seen to be positioned in a removing station 40 and which is equipped with its own shaping means 41.

Sequence of Operation—Generally

From the foregoing, it will be appreciated that the turntable 32 can move a plurality of frames around a vertical axis and, more particularly, through a charging station 34, a treating station 37 and a removal or unloading station 40. When the frame 33 equipped with shaping means 35 is in the charging station 34, sand carrying a chemically-treatable binder is introduced into the shaping means. Then, as the turntable indexes 120° (as shown), the frame 33 assumes the position of the frame 36 and is in the treating station 37. At this station, a treating chemical such as gaseous ammonia is introduced into the shaping means to set the sand binder. Finally, after the mold or core has been fixed or set in the station 37, the next index of the turntable 32 brings the frame into the position occupied by frame 39 wherein removal of the core or mold is effected. Thus, while one frame is being charged, another is simultaneously treated and a third is simultaneously manipulated to remove the treated shaped sand part. It is therefore possible to develop mold parts and core parts simultaneously whereby all parts for a casting are producible at the same time and under the same conditions—making for more reliable quality in the ultimate casting. Also, where the cycle is of the order of two minutes, a complete mold and core can be developed in a relatively short time so that valuable space does not have to be allocated for storage. Other advantages, both operational and structural, can be appreciated by those skilled in the art when it is understood that the invention permits the simultaneous development of a variety of sand parts.

Charging Turntable

Figure 3:
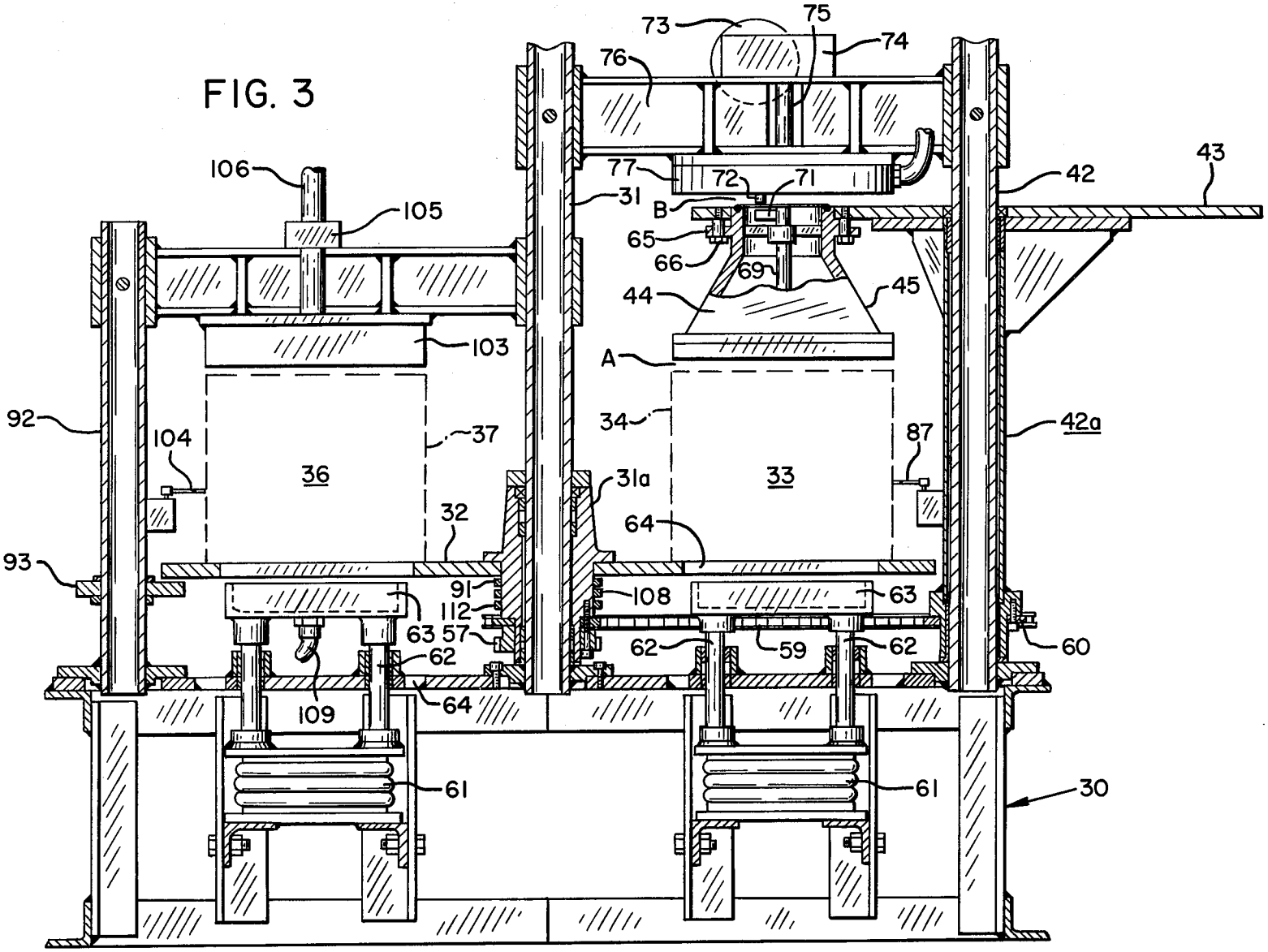
FIG. 3 is an enlarged vertical sectional view taken along the angled sight line 3—3 applied to FIG. 1.

Referring still to FIG. 1, the numeral 42 designates a second post which is supported by the base 30. As seen in FIG. 3, a portion 42*a* of the post is rotatably supported thereon and carries the second turntable 43 much the same as the sleeve portion 31*a* of the post 31 carries the turntable 32.

Figure 2:
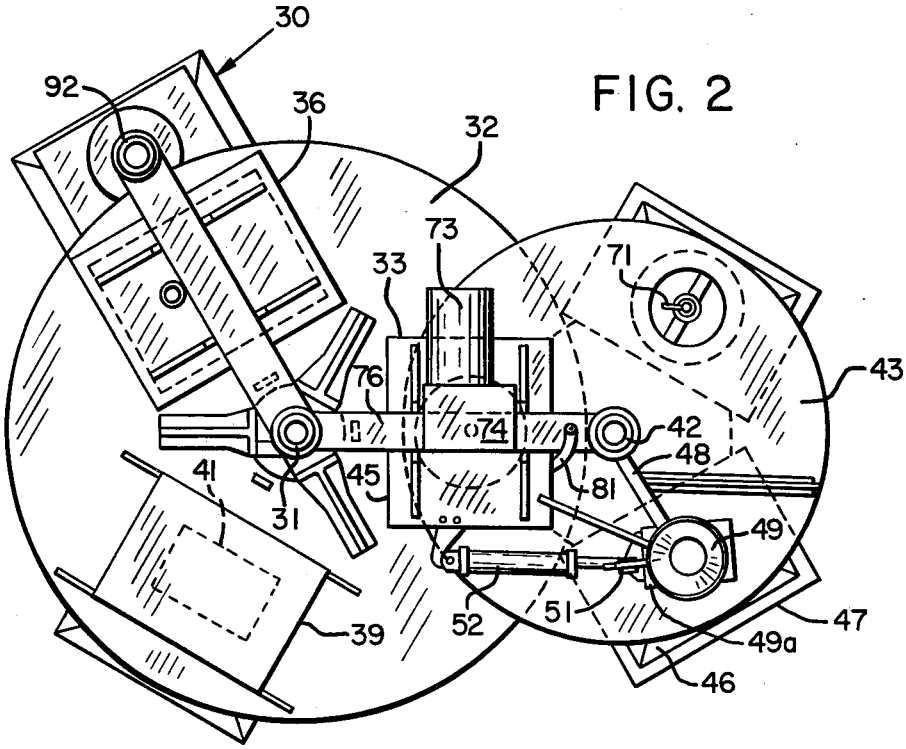
FIG. 2 is essentially a simplified top plan view of the apparatus of FIG. 1.

The turntable 43 is equipped with a plurality of blow-heads for charging sand into the frames. As seen in FIGS. 1-3, the head 44 is in a charging mode or station 45 which is vertically aligned with and above the charging station 34 previously referred to with respect to frame 33 of turntable 32. A second blow-head 46 is in a sand adding station 47 (compare FIGS. 1 and 2).

The post 42 (see FIG. 1) is equipped with a laterally extending arm 48 which supports a funnel 49. Sand complete with a chemically treatable binder is delivered to the funnel 49 by means of a trough 50 which may be auger-powered. The signal for delivery of sand to the funnel 49 is advantageously generated by means of a sensor 51 (still referring to the upper right hand portion of FIG. 1). The funnel 49 is equipped with a gate 49*a* which is operated by means of a cylinder and piston rod unit 52. Thus, the opening of the gate 49*a* permits sand to be introduced by gravity into the blow-head 46 when the same is in the sand adding station 47.

Prime Mover

Figure 8:
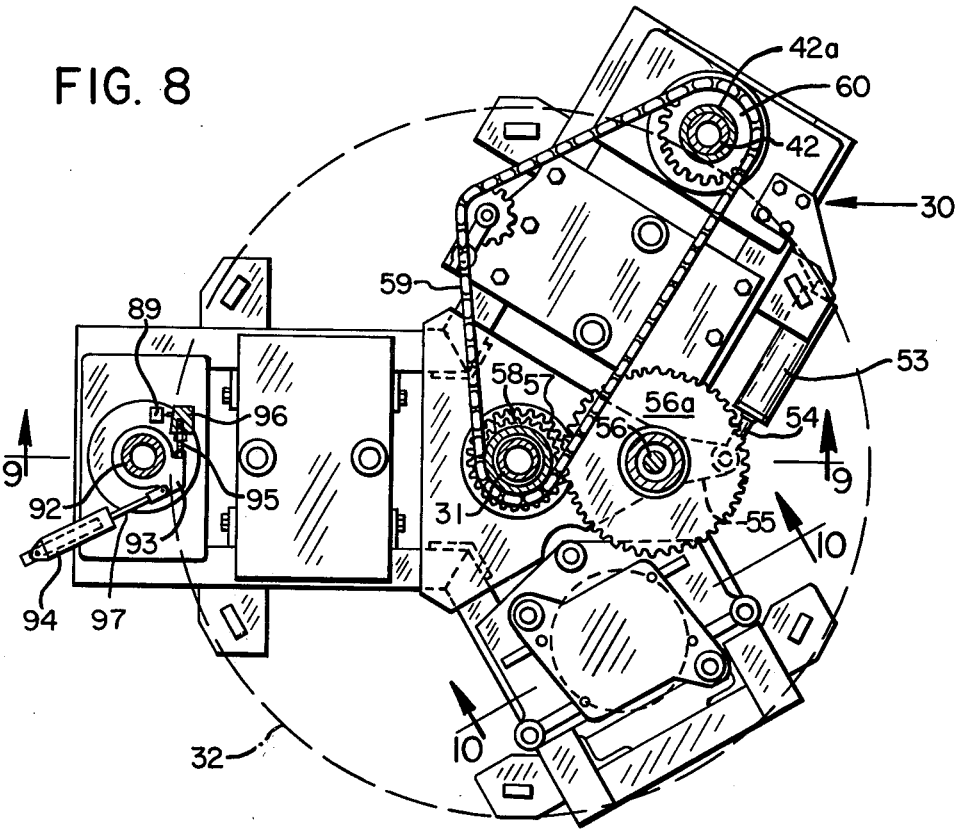
FIG. 8 is a fragmentary plan view, partially in section, such as would be seen along the sight line 8—8 applied to FIG. 1.
Figure 9:
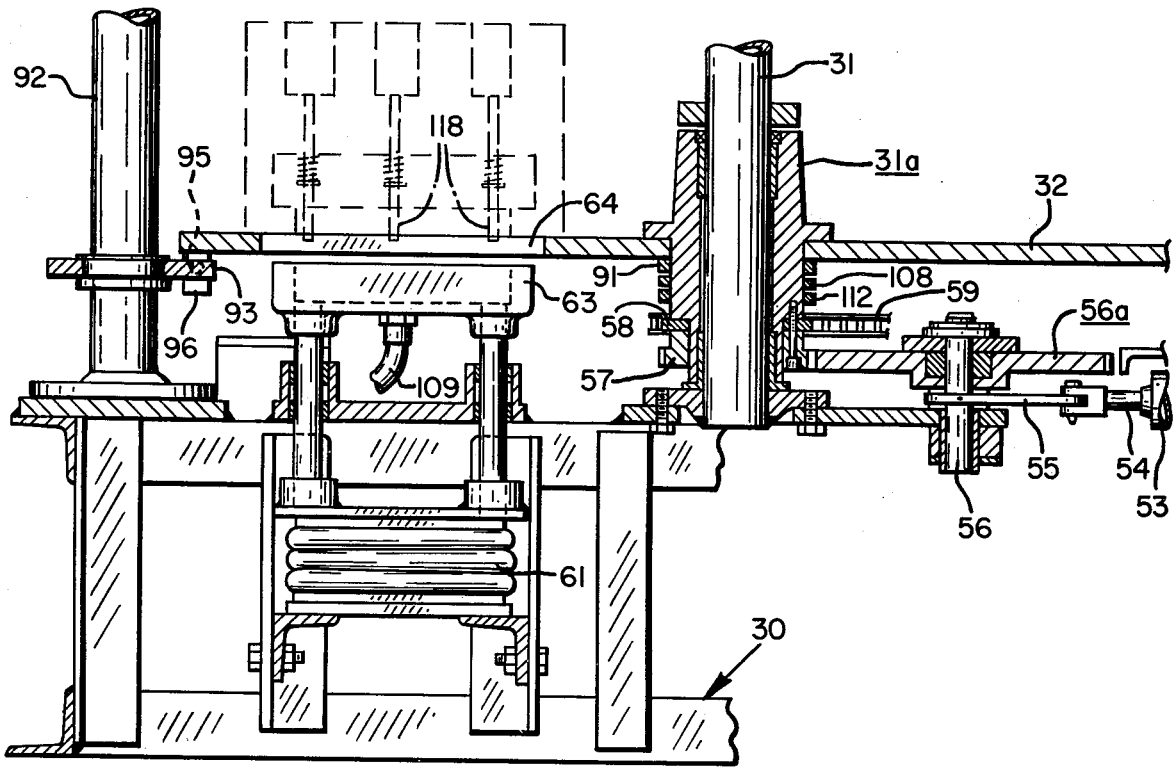
FIG. 9 is an enlarged sectional view taken along the line 9—9 of FIG. 8.

The prime mover for the apparatus is a fluid cylinder and piston rod unit 53 (see the upper right hand portion of FIG. 8). The unit 53 is pivotally mounted on the base 30 and the piston rod 54 is equipped with a ratchet connection 55 for the post 56. The post 56 is rotatably carried by the base 30 (see FIG. 9). As seen in FIGS. 8 and 9, a gear 56*a* is carried by the post 56 and mates with a spur gear 57 which is provided as part of the sleeve 31*a*. The sleeve 31*a* (still referring to FIGS. 8 and 9) is equipped with a sprocket 58 which is coupled by means of chain 59 to a driven sprocket 60 forming part of the sleeve 42*a*. Thus, as the piston rod 54 is extended, it rotates the gear 56*a* in a clockwise fashion—which in turn rotates the sleeve 31*a* counterclockwise. This motion is delivered directly to the first turntable 32 to cause the frames to proceed through the various stations. By virtue of the chain and sprocket connection to the sleeve 42*a*, the blow-head or second turntable 43 is indexed simultaneously, also at 120° intervals, as illustrated. In the particular illustration given, the second or blow-head turntable 43 provides only two functions, viz., sand addition and charging of the frames. However, with different shaped frames or shaping means thereof, the unused station developed by three indexes per cycle can be used to advantage.

Elevating Means

The method and means for charging sand into the frames 33, 36, 39 (or, more particularly, the shaping means 35, 38, or 41 thereof, respectively) will now be described. As seen in FIG. 3, the frame 33 is positioned immediately below the charging or blow-head 44 but in spaced relation therewith. This situation is also reflected in FIG. 4 but in FIG. 6, the head 44 is in contact with the frame 33 so that it is possible to literally "blow" the sand from the head 44 into the frame 33. It will be appreciated that each of the heads 44, 46, etc., is equipped with a bottom closure as at 44*a* (see FIG. 6) but which is suitably apertured as at 44*b* to permit the passage of sand therethrough but only when pressure is applied thereto. To bring about the engagement of the frame 33 (other frame in the charging position 34) into engagement with the blow-head 44,, 46, etc. in the charging position 45, an air bag 61 is utilized to elevate the frame 33 (see FIG. 3). The air bag 61 is operably associated with posts 62 which support a platen or plate-like member 63. When the air bag or other elevating means is pressurized, the platen rises vertically through an opening 64 in the turntable 32. This brings the frame 33 into contact with the head 44 to eliminate the space A (designated in FIGS. 3 and 4). Further upward movement of the platen 63 continues to elevate the frame 33 and now the head 44 so as to eliminate the space B (see FIGS. 3 and 4) and which results in the configuration of elements seen in FIG. 6.

Figure 6:
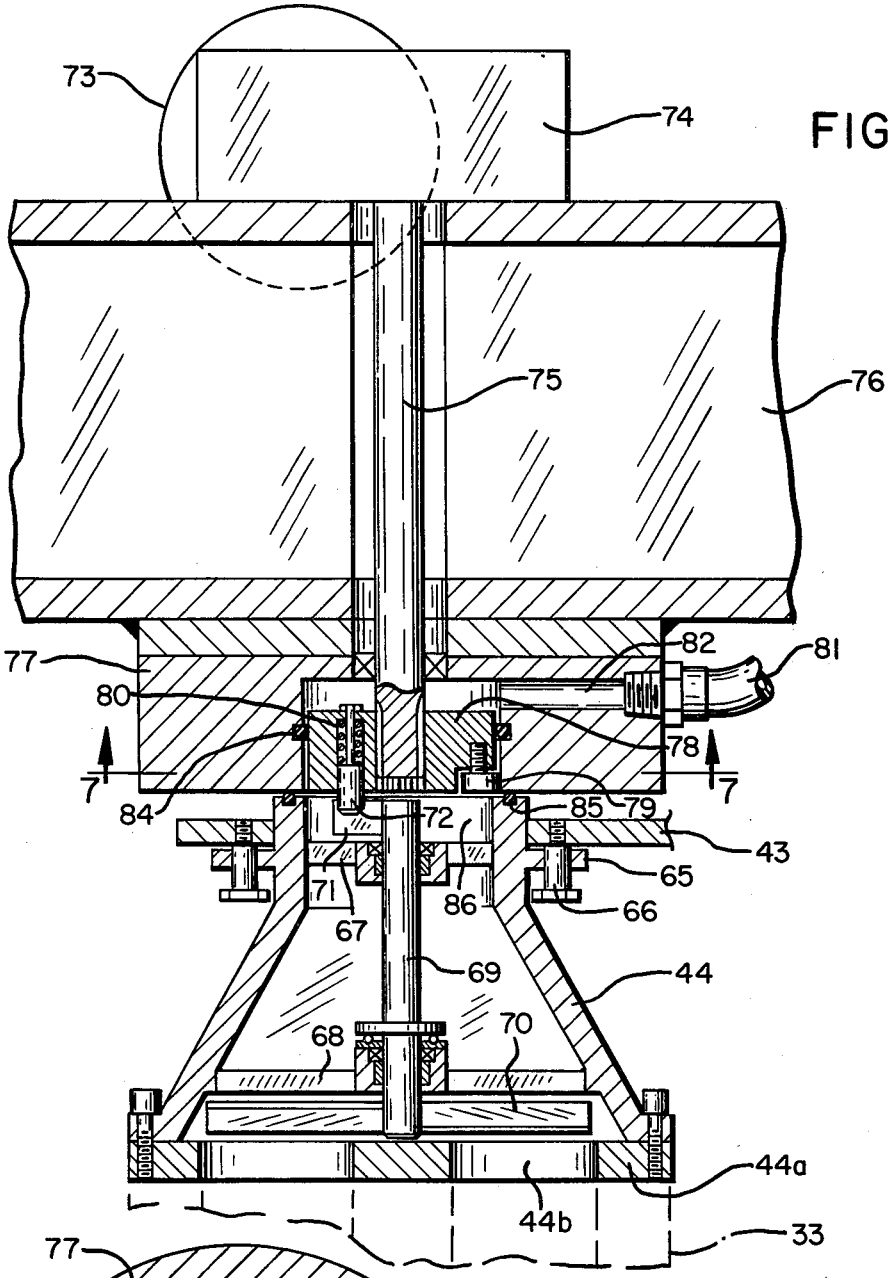
FIG. 6 is a view similar to FIg. 4 but with the head activated.

To facilitate this last-described movement, the head 44 is equipped with a plurality of lugs 65 (see FIGS. 4 and 6). Passing through openings in the lugs 65 are headed studs 66 which serve to support the head 44 when the same is not engaged by a frame 33 and which further serve to guide head 44 preliminary to "blowing" when it is being elevated by upward movement of the frame 33.

Agitating Means

Figure 7:
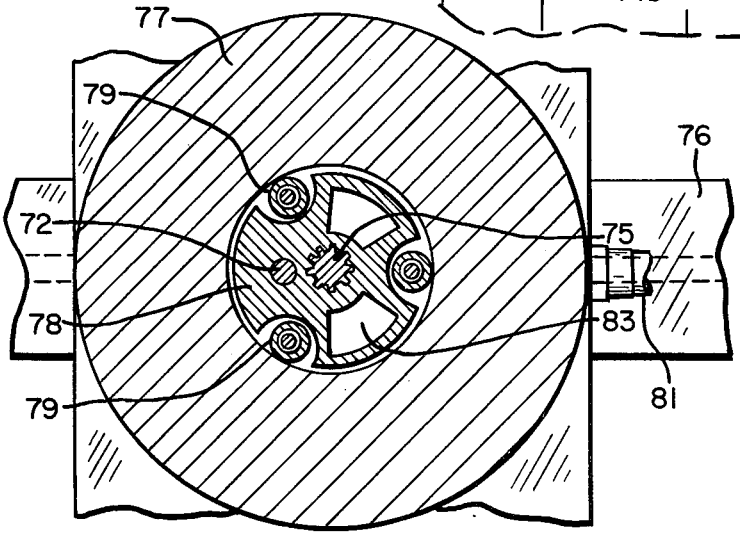
FIG. 7 is an enlarged sectional view taken along the sight line 7—7 of FIG. 6.

The head 44 is interiorily equipped with bearing brackets 67 and 68 (see FIGS. 4 and 6) which support a vertical shaft 69 equipped with an agitator impeller 70. The impeller 70 is caused to rotate and keep the sand finely divided so as to pass through the slots 44*b*. For this purpose, the shaft 69 is equipped with a laterally or radially extending lug 71 which, when the same is engaged by a drive post 72 is operative to rotate the shaft 69 and hence the impeller or vanes 70. This is the condition of elements illustrated in FIGS. 6 and 7.

The means for turning the eccentrically positioned post 72 and hence the radially extending lug 71 includes a motor 73 (see the upper central portion of FIG. 1). The motor 73 is equipped with a suitable reducer 74, the output of which is delivered to a vertical shaft 75. The motor 73 and reducer 74 are supported on a cross beam 76 extending between posts 31 and 42 (see also FIG. 6).

Blowing Means

Supported in depending fashion from the beam 76 is a block 77 which provides a manifold for introduction of compressed air and also supports a disc 78 which carries the drive post 72. As can be best seen from a comparison again of FIGS. 4 and 6, the disc 78 is fixed to a splined portion of the shaft 75 so as to rotate therewith. The disc 78 is equipped with rollers 79 which ride against interior walls on the block 77 and therefore guide the disc 78. The drive post 72 is resiliently mounted as by a spring 80.

When the head 44 rises to eliminate the space B, it is possible that the lug 71 may be in alignment with the drive post 72. This could cause a rupture of an element and interfere with the drive of the impeller vanes 70. However, the spring loading of the drive post 72 permits the post 72 to rise above the lug 71 and regain its down position after the disc 78 has been rotated to position the drive post 72 in other than vertical alignment with the lug 71.

A fluid pressure hose 81 is arranged to deliver compressed air or the like into a chamber or manifold 82 in the block 77. The pressure fluid then passes through openings 83 in the disc 78 and then into the interior of the head 44 for driving the sand through the slots 44*b* in the bottom plate 44*a*. To insure that the pressure fluid is delivered properly, a ring seal is provided as at 84 between the disc 78 and the block 77 and another ring seal is provided as at 85 about the inlet opening 86 of the head 44.

Safety Controls

Before air or other fluid is delivered under pressure through the hose 81, the sensor 87 (see the central light hand portion of FIG. 3) must be activated to indicate the presence of a frame 33 in the charging position 34 under the head 44.

Figure 13:
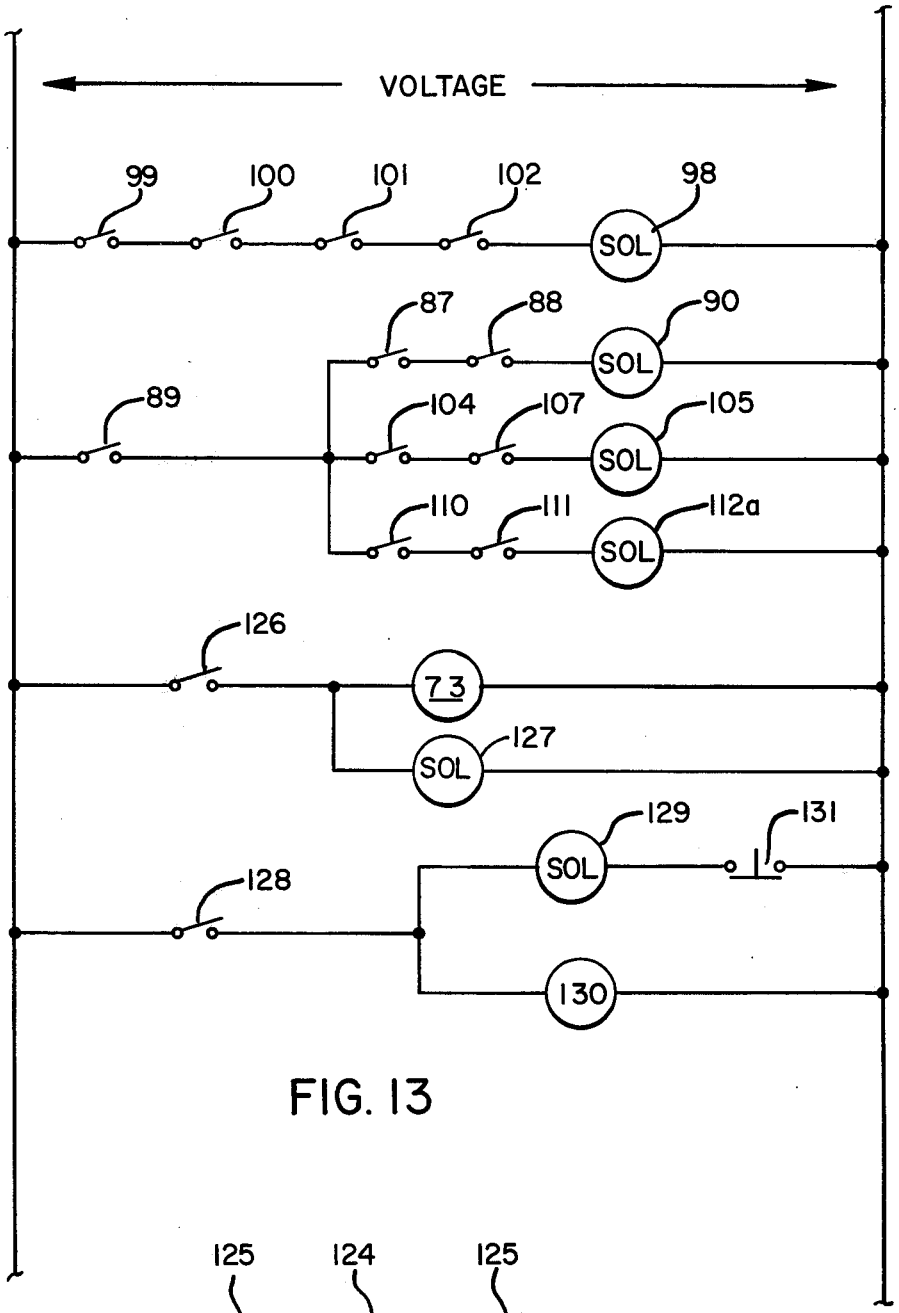
FIG. 13 is a schematic diagram featuring certain controls associated with the inventive apparatus.

As can be appreciated from a consideration of FIG. 13, other switches as at 88 and 89 must be closed before an electrical signal can be delivered to the solenoid valve 90 which is interposed in the air line to the air bags 61.

The switch 88, for example, is actuated by a ring 91 (see the central part of FIG. 3) which is affixed to the sleeve 31*a* supporting the turntable 32. Thus, as the turntable indexes to the proper position, a notch (not shown) in the ring 91 is aligned with the arm of the switch 88 to close the same. The switch 89 is seen in FIG. 8 and is responsive to a position on the periphery of the first turntable 32. Thus, before sand can be blown into the shaping means 35 of the frame 33, the sensor 87 must be activated to indicate that there is actually a frame 33 in the charging position 34.

Carried by the same portion of the base 30 that carries the switch 89 (see FIG. 8) is a post 92 (see also FIG. 1) which rotatably supports an L-shaped arm 93. The L-shaped arm 93 is pivotally connected to a cylinder and piston rod unit 94 suitably carried by the base and is engaged by a stud 95 carried by a block 96 on the turntable 32. Thus, as the turntable indexes into the desired position for the three simultaneous functions, the stud 95 engages the L-shaped arm 93 and any carryover momentum is dissipated by the pressure within the cylinder and piston rod unit 94 which serves as a cushion. As the momentum is cushioned, the block 96 is stabilized in a position so as to close the switch 89 (still referring to FIG. 8). No movement of the turntable can occur until the cylinder and piston rod unit 94 is actuated to retract the L-shaped arm out of the path of the stud 95 and permit the block 96 to pass thereby. Therefore, in operation, the same signal that powers the indexing cylinder 53 to extend the piston rod 54 also pressures the unit 94 to retract the piston rod 97 thereof. Suitable solenoid valve means as at 98 (see FIG. 13) performs this function when the start switch 99 is closed. The numerals 100, 101 and 102 relate respectively to three sensor switches which are associated with the three air bags and which detect whether the air bags are collapsed so that the platen 63 thereof are below the turntable 32, i.e., withdrawn from the openings 64—which otherwise would preclude indexing.

Sand Binder Treatment

Referring again to FIG. 3, a frame 36 in the position designated 37 (at the left hand side of the view) may be elevated by its associated air bag in the same manner as described previously with respect to the frame 33. When this occurs, the frame 36 engages a gas manifold head 103 which makes possible the delivery of gas for treating the binder to convert the same and solidify the shaped sand.

Again, as with the frame 33, the frame 36 (see FIG. 3) is associated with a position sensor 104 which needs to be actuated before electrical energy can be delivered to a solenoid 105 in the gas line 106. Further safeguards are provided in the form of requiring the closure of a switch 107 which is responsive to the position of a notch (not shown) in a ring 108 also mounted on the sleeve 31*a* but below the ring 91 (see the central portion of FIG. 3).

Provided below the frame 36 in the treating station 37 is an exhaust fan (not shown) which is coupled by hose 109 to the frame 36 for exhausting gas flowing through a frame in the treating station. For example, the sand binder may be a two component urethane forming system which is accelerated, i.e., catalyzed by a gas such as an amine. A specific process may be found in U.S. Pat. Nos. 3,409,579 and 3,429,848.

Sand Part Removal

Another air bag (again designated 61) is associated with each frame successively but in the position 40 for removing the sand part (either core or mold) from the shaping means 41. This is illustrated in FIG. 10 with variations of the frame shaping means seen in FIGS. 11 and 12.

As before, i.e., with the frames 33 and 36, the frame 39 (see, for example, FIG. 12) much be in proper position before the ejection mechanism operates. This is sensed by a sensor 110 (see FIG. 13) similar to those provided at 87 and 104. Also, the table must be positioned properly as sensed by the sensor 111 bearing against the signal ring 112 (similar to the sensing elements 88 and 107 relative to the rings 91 and 108, respectively). When this occurs, solenoid 112*a* (still referring to FIG. 13) is closed to internally pressurize the bag 61.

Figure 10:
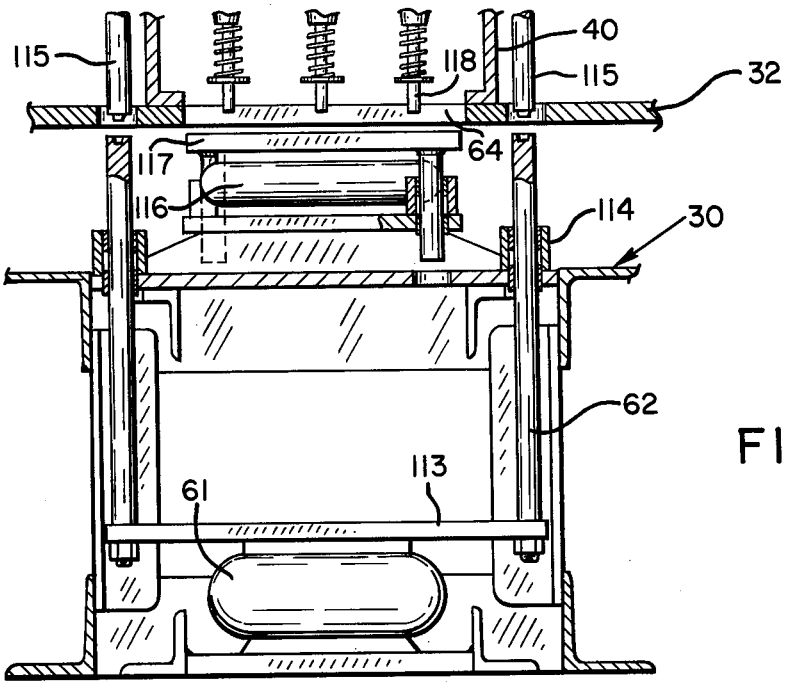
FIG. 10 is a fragmentary elevational view partially in section showing a portion of the apparatus relating to the removal or eject operation such as would be seen along the line 10—10 of FIG. 8.

Referring now to FIG. 10, as the bag 61 is pressurized therein, it causes rods 62 to move upwardly. The rods 62 are connected by means of a plate 113 supported on the air bag 61. The rods 62 are suitably guided in the base 30 by means of bearing sleeves 114. As the posts 62 move upwardly, they engage aligned posts 115 (see FIG. 12) on the upper half of the horizontally split frame 39. This brings about separation of the halves of the frame permitting removal of the shaping means 41 which may be either a mold or a core box. To facilitate dislodgment of the sand part from the framing means, a secondary air bag as at 116 (see FIG. 10) is provided on the base 30. When this is internally pressurized, a platen or plate 117 affixed thereto is caused to rise upwardly through an opening 64 in the first turntable 32 and engage spring loaded plungers 118. These plungers or pins serve to eject the core or mold.

Figure 11:
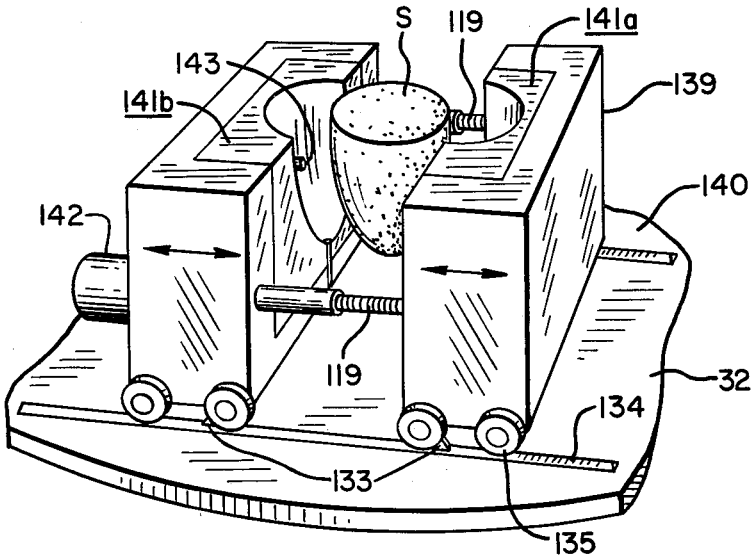
FIG. 11 is a perspective view of a vertically split frame featuring a sand core.
Figure 12:
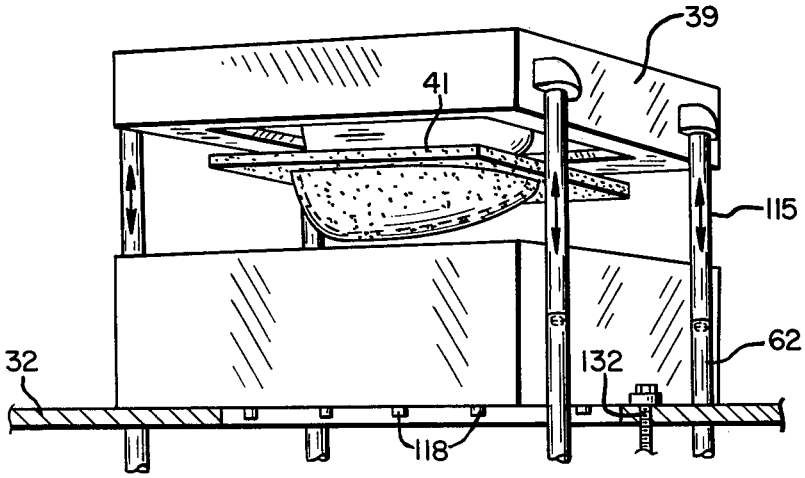
FIG. 12 is a perspective view of a horizontally split frame suitable for developing a mold.
Figure 14:
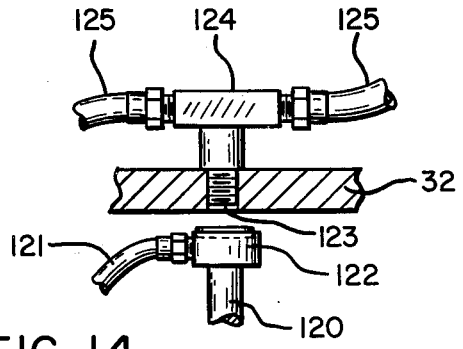
FIG. 14 is a fragmentary elevational view of apparatus employed for separating the frame of FIG. 11.

An alternative construction is seen in FIG. 11 where the frame is designated by the numeral 139 and consists of two halves separable along a vertical plane. Each of the frame halves carries a portion of the shaping means as at 141*a* and 141*b*. In this case, when the frame 139 enters the removal or eject station 140, the solenoid 112*a* delivers air to an air motor 142 causing the rotation of the screws 119 and thus the horizontal separation of the frame halves. More particularly, the inflation of the air bag 61 causes elevation of the plunger 120 (see FIG. 14) which couples an air line 121 via head 122 to a passage 123 in the turntable 32. This then delivers pressurized air through the fitting 124 and line 125 to the previously referred to air motor.

Operation

In the operation of the machine and method of the invention, sand is first mixed with binder components which unite to form a urethane and which can be used in very small quantity (of the order of about 1%) to fix or set the sand for casting parts without the need of heat. Such binder-mixed sand is introduced through a trough 50 into a funnel 49 (see the upper right hand portion of FIG. 1). The amount of sand is regulated by means of a height sensor 51. The funnel 49 is fixed with respect to the base 30, being mounted on an arm 48 extending laterally from a vertical post 42.

Rotatably mounted on the post 42 is a second turntable 43. This turntable carries a plurality of blow-heads such as identified at 44 and 46 (again in the upper right hand portion of FIG. 1). When a blow-head—as at 46—is below the funnel 49, the gate 49*a* is opened and sand flows by gravity into the generally frusto-pyramidal blow-head 46. Thereafter, the turntable 43 is rotated, more particularly, indexed, so as to position a blow-head in the position indicated 44 in FIG. 1.

While the turntable 43 is being indexed (in the illustration give, through 120°), the first turntable 32 is similarly indexed. This brings a frame 33 (still referring to the right hand portion of FIG. 1) to the loading or charging position 34. The position 34 results in having the frame 33 immediately below, i.e., vertically aligned, with the blow-head 44. The frame 33 is equipped with a shaping means 35 which may be a core box, for example. As the frame 33 enters the charging position 34, it triggers a sensor 87 (see the right hand portion of FIG. 3) which in effect, energizes or "arms" the filling circuit. If, for some reason, a frame is not in this position, no charging can occur. It will be appreciated that frames may be removed and replaced from time to time—and different types of frames employed (compare the frame 39 of FIG. 12 with the frame 139 of FIG. 11).

However, when the appropriate signal is given to the sensor 87, and the turntable 32 is in precise position as reported by the sensors 89 and 88 (see FIG. 13) and which correspond respectively to axial and peripheral triggering elements (as at 91 in FIG. 3 and 89 in FIG. 8), the solenoid 90 is energized and compressed air is delivered to the air bag 61. Alternatively, a hydraulic cylinder could be employed but, in any event, the signal from the solenoid 98 raises the platen 63 (referring to the right hand portion of FIG. 3) so as to elevate the frame 33 (and therefore the head 44) to eliminate the gaps A and B—thereby achieving the configuration of elements seen in FIG. 6. There the upper portion of the head 44 is in sealing engagement (via the seal 85) with the undersurface of the block 77. When this occurs, a switch 126 (see FIG. 13) is closed which powers the motor 73 to rotate the impeller agitator 70 and also opens a solenoid 127 in the compressed air line 81—thereby blowing binder-equipped sand into the shaping means 35.

Simultaneously with this operation, another blow-head 46 is being filled with sand—and on the level of the turntable 32, a previously charged frame is being treated with catalytic gas to convert the binder components into a firm adhesive matrix.

This is achieved in the station designated 37 where the presence of the frame 36 (see the left hand portion of FIG. 3) is sensed by the sensor 104. This switch, along with the switches 89 and 107 are in series and actuate the solenoid 105 which internally pressurizes the air bag 61 under the frame 36. This brings the frame 36 into contact with the head 103 and actuates a limit switch 128 delivering current to a solenoid valve 129 in the gas line 106 and to an exhaust fan 130. This results in the delivery of catalytic gas through the line 106, the excess of which is drawn off by the exhaust fan 130. After a predetermined time, a time delay relay 131 opens to stop the flow of electrical current to the solenoid 129 and thereby stops the flushing of a sand part with the catalytic gas. However, the exhaust fan 130 continues to effect a purge of the catalytic gas from the shaping means 38. Normally, the time between indexes is of the order of 20 seconds in the illustration given, this being determined primarily by the time required for the removal operation which occurs in the frame 39 in the removal or eject position 40.

As indicated previously, the stripping or removal is occurring concurrently with the charging and gassing operations. The filling of the air bag 61 below the station 40 is achieved by the closing of the solenoid 112*a* after the switches 89, 110 and 111 have been appropriately actuated. This results in the opening of the frame 39 or 139, as the case may be, to permit the sand part S (see FIG. 11) to be removed. In FIG. 11, the sand part S has just been ejected from the shaping means portion 141*b* by the extension of an appropriately actuated plunger 143 and is in the position where it is manually grasped by the hand of an artisan (not shown) for upward removal from the frame 139.

The inventive machine thus accepts what can be considered a standardized frame 39 or 139 in which various sizes and shapes of shaping means, viz., core boxes or molds, can be inserted to produce the sand part wanted. The inventive machine further runs three separate stations independently of each other but coordinated in time, each with what might be considered its own self indexing blow-head. This capability further allows the inventive machine to produce three separate types of cores or molds in any combination. For example, as shown, the stations 34 and 37 could be producing cores while the station 40 a mold so that all of the sand parts necessary for a casting operation are produced virtually simultaneously, i.e., within about one minute. It will be seen that the frames 33, 36, 39 (or 139) are all of the same size so that ready interchangeability can be attained between both horizontally and vertically split frames. The frames, whether horizontally or vertically split may be supported on the turntable 32 and, because of the substantial weight, do not shift laterally. However, to immobilize the frames, I provide restraints as at 132 in FIG. 12 or 133 relative to FIG. 11. The restraints 133, for example, are dogs upstanding from the tracks 134 on which the wheels 135 ride. In the closed position, the outboard wheels are contacting the dogs 133 while in the open position (as shown in FIG. 11) the inboard wheels contact the dogs 133. This serves to prevent inadvertent shifting of the frames upon start-up and stop of the indexing motion where the acceleration or deceleration may tend to shift the frame slightly. The very weight of the frames though maintains them substantially in position, the only movement contemplated being the vertical movement of the frame in the positions 34 and 37 when they are moved upwardly under the influence of the air bag 61.

While in the foregoing specification a detailed description of the invention has been set down for the purpose of illustration, many variations in the details herein given may be made by those skilled in the art without departing from the spirit and scope of the invention.

I claim:

1. A machine for shaping sand into cores or molds comprising:

a base, a first vertically extending post means rotatably mounted on said base, a first turntable fixed to said first post means above said base for rotation with said first post means, at least three frames supporting shaping means mounted on said first turntable in angular spaced relation for shaping sand in each of said frame, means on said base for indexing said frames through a first orbit and respectively through stations for charging said shaping means with sand, treating said shaped sand and removing the treated shaped sand, a second vertically extending post means rotatably mounted on said base and spaced outside said first orbit, a second turntable fixed to said second post means above said first turntable, at least two horizontally spaced heads for charging sand to said shaping means mounted on said second turntable.

said indexing means including a prime mover connected to both of said post means to index said second turntable through said filling and charging stations in synchronism with said first turntable and move said heads through a second orbit wherein the second turntable charging station is vertically alignable with the first turntable charging station, means on said base for engaging each frame when the same is in said first turntable charging station and moving the same upwardly to engage a head in said second turntable charging station, and means responsive to the positions of said turntables to deliver pressure fluid to a head in said second turntable charging station to force sand therefrom into a frame in said first turntable charging station and in sealing engagement with said head.

2. The structure of claim 1 in which said responsive means includes first and second switches mounted on said base positioned respectively for engagement with said first post means and the periphery of said first turntable for actuating said engaging means, and a third switch operably associated with a head in said second turntable charging station to sense sealing engagement of a frame with said head for delivering pressure fluid to said head.

3. The structure of claim 2 in which said first turntable is equipped with stud means for actuating said second switch, a cylinder and piston rod unit mounted on said base in the path of said stud means to cushion the stopping of said turntable and position said stud means for engagement with said second switch, and solenoid valve means for retracting said piston rod upon initiation of a subsequent indexing.

4. The structure of claim 1 in which said first and second post means each include a post fixed on said base and a sleeve rotatable thereon connected to the turntable associated therewith, said indexing means being connected to said sleeves, each said post extending above said second turntable, a cross beam fixed to each said post and connecting the same above said second turntable, a block on said cross beam for delivering pressure fluid to a head in said second turntable charging station, each head being vertically slidably mounted on said turntable whereby upward movement of a frame first causes engagement of a frame in said first turntable charging station and thereafter engagement of said head with said block.

5. The structure of claim 4 in which a motor is mounted on said cross beam and equipped with a drive disc, an impeller rotatably supported in each head for engagement with said drive disc upon engagement of said head with said block.

* * * * *